United States Patent [19]

Schramm et al.

[11] 4,073,348

[45] Feb. 14, 1978

[54] IMPACT DRILLING TOOL

[75] Inventors: Heribert Schramm, Stuttgart; Steffen Wüensch, Dettenhausen, both of Germany

[73] Assignee: Robert Bosch GmbH, Stuttgart, Germany

[21] Appl. No.: 704,783

[22] Filed: July 13, 1976

[30] Foreign Application Priority Data

July 25, 1975 Germany ..... 2533284

[51] Int. Cl.[2] ..... E02D 7/02

[52] U.S. Cl. ..... 173/48; 173/109; 173/95

[58] Field of Search ..... 173/47, 48, 109, 94, 173/95

[56] References Cited

U.S. PATENT DOCUMENTS

| | | | |
|---|---|---|---|
| 2,110,957 | 3/1938 | Kollock | 173/109 |
| 2,492,840 | 12/1949 | Bugg | 173/95 |
| 3,456,740 | 7/1969 | Paule et al. | 173/109 |
| 3,685,594 | 8/1972 | Koehler | 173/48 |
| 3,695,365 | 10/1972 | Schadlich | 173/109 |
| 3,777,825 | 12/1973 | Gullich | 173/48 |

FOREIGN PATENT DOCUMENTS

| | | | |
|---|---|---|---|
| 232,743 | 3/1911 | Germany | 173/95 |
| 2,364,344 | 6/1975 | Germany | 173/109 |

*Primary Examiner*—Robert Hafer
*Attorney, Agent, or Firm*—Michael J. Striker

[57] ABSTRACT

An impact drilling power tool has a housing, a spindle element mounted in the housing for rotation about an axis and for displacement in axial direction, and an impact element mounted in the housing for displacement axially toward and away from the spindle element. The impact element has an axially arranged extension coaxially received within a blind bore of the spindle element. The impact element has a plurality of cam surfaces provided on helical radial projections of the impact element, and rolling bodies of a cam follower element contact the respective cam surfaces and displace the impact element against the force of coaxial helical springs until encountering interruptions of the projections, upon which the springs rapidly displace the impact element toward the spindle element and an end face of the axial extension impacts the bottom of the blind bore. An output shaft of a driving motor drives a countershaft and via the same and meshing gears also the impact element and the spindle element. The power tool may operate either in a normal drilling mode or in an impact drilling mode.

20 Claims, 6 Drawing Figures

IMPACT DRILLING TOOL

BACKGROUND OF THE INVENTION

The present invention relates to power tools in general and more particularly to a power drill which is capable of working in a normal drilling and an impact drilling mode.

There are already known various types of impact drilling power tools in which a driving motor is accommodated in a power tool housing which further accommodates a driving arrangement or transmission that can be switched between a normal drilling mode and an impact drilling mode and which rotates a spindle element mounted in the housing. The axial movement of the spindle element when the power drill operates in an impact drilling mode results from an axial displacement of an impact element which impacts against the spindle element. Usually, the impact element becomes active only when the spindle element, which is acted upon by a force of at least one spring, is subjected to an axial force opposite to the force of the spring, whereby the power drill is switched from its normal drilling mode into the impact drilling mode.

In one of such conventional impact power drill constructions, a single or a multiple helical cam surface is formed at the outer circumferential surface of the impact element, and a number of axially extending depressions is provided which corresponds to the number of the cam surfaces. A corresponding number of rolling bodies is provided which are located radially outwardly of the outer circumferential surface of the impact element and cooperate with the cam surfaces and the depressions. The rolling bodies are constitutent parts of a cam follower element which further includes an outer race having an annular groove in which the rolling bodies are received, the outer race being stationarily mounted in the housing and thus preventing the rolling bodies from axial displacement. In this prior art device, the cam surface may be provided on radially extending helical projections, and the axial depressions may be constituted by interruptions, the rolling bodies contacting the outer circumferential surface of the impact element and, in the impact drilling mode, also the cam surfaces to thereby displace the impact element in the axial direction against the force exerted by a spring so that energy is stored in such spring until the rolling bodies are juxtaposed with the respective interruptions upon which the impact element is released for a rapid displacement in the axial direction under the influence of the spring to thereby subject the spindle element to an axial impact.

In one conventional power drill of this type, the impact element is of a sleeve-like configuration and is mounted on the spindle element for displacement axially of the latter. Experience with this construction has shown that the spindle element must have an excessive axial length in view of the fact that the spindle element must extend over the entire length of the housing. In addition thereto, the excessive length of the spindle element makes the entire power drill considerably long and thus renders handling of such power drill difficult.

SUMMARY OF THE INVENTION

Accordingly, it is a general object of the present invention to avoid the disadvantages of the prior art.

More particularly, it is an object of the present invention to provide a power drill which is not possessed of the disadvantages of the prior-art power drills.

It is a further object of the present invention to provide a power drill which is simple in construction and reliable in operation.

A concomitant object of the present invention is to provide a power drill which has a rather small axial dimension.

A still another object of the present invention is to provide a power drill in which the impacting action is more pronounced than in the prior-art impact power drills.

It is yet another object of the present invention to provide a power drill which can be operated both in the normal drilling mode and an impact drilling mode.

In pursuance of these objects and others which will become apparent hereafter, one feature of the present invention resides, briefly stated, in a power tool, in a combination which comprises a housing; a spindle element mounted in the housing for rotation about an axis; drive means for rotating the spindle element; and means for subjecting the spindle element to axially oriented impacts, including an impact element mounted in the housing for reciprocation in direction of the above-mentioned axis, means for reciprocating the impact element also driven by the drive means, a blind axially oriented bore in one of the above-mentioned elements and having a first impact surface, and an axially oriented extension on the other element and received in the blind bore of the one element and having a second impact surface which impacts the first impact surface upon axial displacement of the impact element in direction toward the spindle element. Preferably, the first impact surface is a bottom surface of the bore and the second impact surface is a free end of the axial extension. The blind bore may be provided in the spindle element, being coaxial therewith, and the axial extension may be provided upon and be integral with the impact element.

In this manner, a very short spindle element is obtained, which favorably reflects in the proportion of the impacting to the impacted mass. A particularly advantageous impact characteristic is obtained when the mass of the impact element approximately equals that of the spindle element, inasmuch as the drilling progress in the impact drilling mode is most advantageous under these circumstances.

According to a further aspect of the present invention, the drive means also rotates the impact element, and the reciprocating means includes at least one cam surface at an outer circumferential surface of the impact element, which cam surface extends helically over a part of the circumferential surface and has an axial depression. Instead of one, a plurality of such helically extending cam surfaces may be provided. In this embodiment, biasing means urges the impact element toward the spindle element, and at least one cam follower element is retained in the housing against axial displacement and is adapted to engage the cam surface or surfaces of the impact element to thereby displace the impact element away from the spindle element against the action of the biasing means when engaging the helical portion of the cam surface, and release the impact element for rapid displacement toward the spindle element under the action of the biasing means when encountering the axial depression. The cam follower element may include an outer race member which is stationarily mounted in the housing and which has an inner circumferential groove, and a rolling body or a plurality of such rolling bodies which is or are partially received in the circumferential groove and which contact the outer circumferential surface of the impact element. Advantageously, the cam follower element constitutes a part of the mounting means which mounts the impact element in the housing.

The above-mentioned cam surfaces may be provided, to advantage, on at least one or a plurality of helical projections which extend radially outwardly beyond the outer circumferential surface of the impact element, in which case the depression is an interruption of the helical projection or projections. The spindle element and the impact element are preferably mounted in the housing for axial displacement between a normal drilling position in which the cam follower element is located out of the path of rotation of the helical projections of the projections, and an impact drilling position in which the cam follower element cooperates with the cam surface or surfaces of the helical projection or projections.

An advantageous embodiment of the present invention is obtained when the biasing means includes two springs one of which permanently urges the impact element toward the normal drilling position thereof, and the other of which stores energy during engagement of the cam follower element with the helical portion or portions of the cam surface or cam surfaces to subsequently release the stored energy when the cam follower element is juxtaposed with the interruption or interruptions while the power drill operates in the impact drilling mode. In this embodiment, the springs may extend between an abutment surface of the housing and an additional blank bore of the impact element, the ends of the springs abutting against such abutment surface and the bottom of such blind bore.

The housing of the power drill may have an axial dimension and an axially forward part and the spindle element may extend only over approximately one-half of the axial dimension of the housing and over the forward part, and may be mounted in such forward part by means of two anti-friction bearings which are interposed between the forward part and the spindle element.

The drive means of the power drill of the present invention includes a driving motor, and a transmission is interposed between the driving motor and the spindle element for rotating the same, and between the drive motor and the impact element for reciprocating the latter. The driving motor may have an output shaft, and the transmission include a gear portion on the impact element, and a countershaft mounted in the housing and driven into rotation from the output shaft and having a gear which meshes with the gear portion of the impact element.

The transmission may further include a gear wheel rigidly connected with the spindle element, and an additional gear mounted on the countershaft for shared rotation therewith and meshing engagement with the gear wheel. The number of gear teeth of the gear wheel may be considerably lower than the number of gear teeth of the gear portion.

The impact element and the spindle element may be connected with one another for synchronous rotation about the above-mentioned axis but with freedom of axial displacement relative thereto. Preferably, such connection is obtained by using axially extending projections on one of the spindle elements and the impact element, and complementary axial recesses on the other element. In a currently preferred embodiment of this facet of the present invention, the axial projections are provided on the above-mentioned extension and the axial recesses are formed in the above-mentioned blind bore.

In a modified embodiment of the present invention the impact element may have an axially extending blind hole within a portion thereof which faces away from the spindle element, that blind hole having a plurality of axially extending recesses. In this embodiment, the drive means may include an output shaft which has a plurality of splines that are received in the axial recesses of the blind hole. This embodiment may further comprise a countershaft and a plurality of gears which are mounted on the output shaft and on the countershaft, respectively, for shared rotation therewith, and in meshing engagement with one another.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
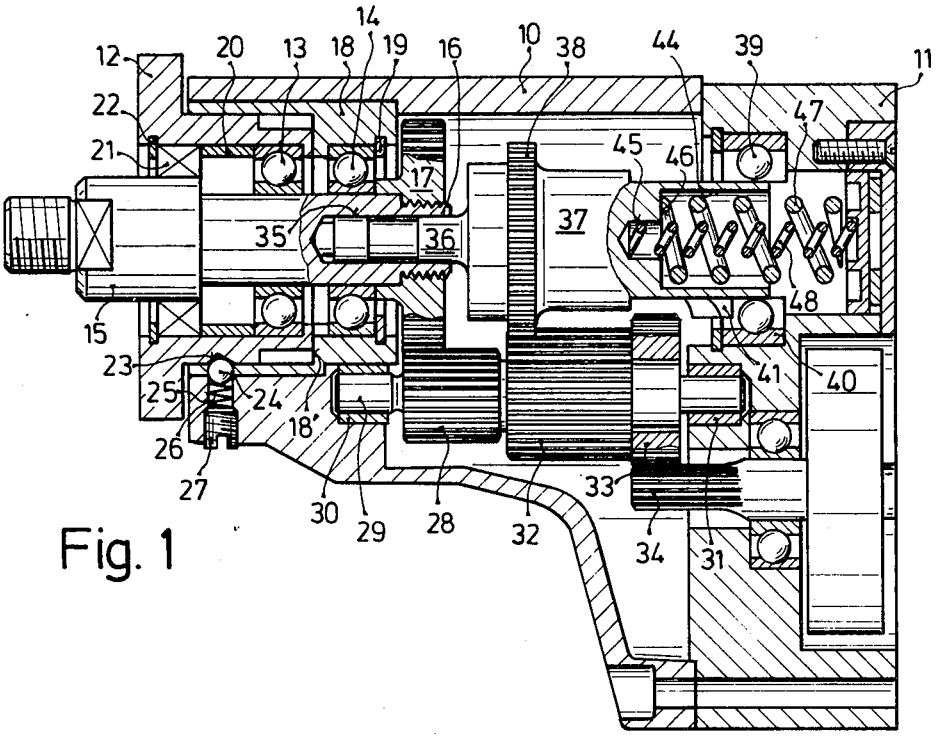
FIG. 1 is a longitudinal sectional view of the power tool of the present invention, with that part of the housing which accommodates the driving motor being omitted.

Referring now to the drawing, and first to FIG. 1, it may be seen that a housing of a power drill has a portion 10 which is closed at one axial side by a flange 11, and on the other side by an adjustment sleeve 12. A non-illustrated motor of a conventional construction having a control switch adjoins the flange 11.

A spindle element 15 is mounted in the housing 10 by means of the adjustment sleeve 12 and an intermediate body 18, by two anti-friction bearings 13 and 14. The spindle element 15 extends only approximately into the middle of the housing portion 10, and has an end portion in the middle region of the housing portion 10 which is designated with the reference numeral 16, a gear wheel 17 being threadedly connected to such end portion 16. The anti-friction bearing 14 is accommodated within the intermediate body 18 and is fixed therein against axial displacement by means of a securing ring 19. A distancing sleeve 20 adjoins and abuts against the anti-friction bearing 13, the distancing sleeve 20 also abutting against a sealing member 21 which is prevented from axial displacement by means of a securing ring 22 which, in turn, results in determination of the exact position of the distancing sleeve 20 and of the anti-friction bearing 13.

Figure 3:
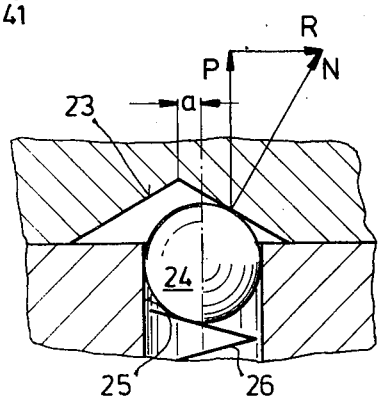
FIG. 3 is a force diagram applicable to the embodiment of FIG. 1.

A plurality of conically shaped depressions 23 are formed at the outer circumferential surface of the adjustment sleeve 12, a sphere 24 being received in each of conical depressions 23. Each of the spheres or balls 24 is further accommodated in one of a plurality of bores 25 which are formed in the housing portion 10. The spheres 24 are pressed into the depressions 23 by springs 26 each of which abuts against a setting screw 27 by means of which the pre-tension of the spring 26 can be adjusted. The reason for this particular arrangement is that the adjustment sleeve 12 is pressed against a shoulder 18' of the intermediate body 18 by a force R illustrated in FIG. 3, both in the normal bearing position which is illustrated in FIG. 1, and in the impact drilling mode in which the adjustment sleeve 12 is displaced relative to the spindle element 15 to an extent corresponding to the axial dimension of the inclined surface of the depression 23.

The gear wheel 17 meshes with a gear wheel 28 which is mounted on a countershaft 29 extending parallel at the spindle element 15 in the housing portion 10. The countershaft 29 is mounted in the housing portion 10 by means of two shaft journals 30 and 31. A gear wheel 32 is mounted on the countershaft 29 adjacent to the gear wheel 28, and a gear wheel 33 is also mounted on the countershaft 29 adjacent to the gear wheel 32. These gear wheels 28, 32 and 33 are rigidly connected to the countershaft 29 for shared rotation therewith. The gear wheel 33 meshes with a gear pinion 34 mounted on or integral with an output shaft of a non-illustrated driving motor.

Figure 2A:
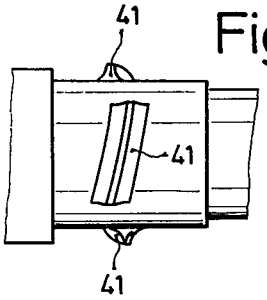
FIG. 2A is a lateral view of an impact element used in the power tool of FIG. 1.
Figure 2B:
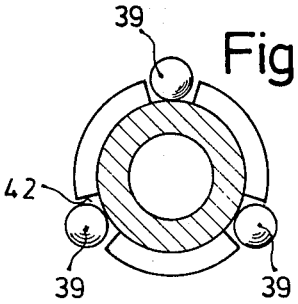
FIG. 2B is a front elevational view of the impact element of FIG. 2A.

A coaxial blind bore 35 is formed in the spindle element 15 at its end region which faces towards the motor, such blind bore 35 extending over approximately one third of the axial length of the spindle element 15. An impact element 37 has a cylindrical extension 36 which extends in the direction of the axis of the spindle element 15. An external gear annulus 38 is formed at the outer circumference of the impact element 37, which gear annulus 38 meshes with the gear wheel 32. The blind bore 35 constitutes one bearing for the impact element 37, and another bearing is constituted by balls 39 which are mounted in a ring 40 supported in the flange 11 against axial displacement. The balls 39 cooperate in a certain position of the impact element 37 with helical projections 41 which extend radially beyond the outer circumferential surface of the impact element 37. Interruptions 42 are arranged between the helical projections 41, which interruptions substantially correspond to the diameter of the balls 40. This is particularly seen in FIGS. 2A and 2B of the drawing.

The impact element has a cylindrical stepped blind bore 44, 45 at the side thereof which faces toward the driving motor, the reference numeral 45 indicating that step of the blind bore 44, 45 which has a smaller diameter. A shoulder 46 extends between the bore sections 45 and 44, and an end of a compression spring 47 abuts against such shoulder 46, the other end of the compression spring 47 abutting against an end portion of the housing 10. Similarly, one end of a weaker spring 48 abuts against the end portion of the housing 10 and the other end of the spring 48 abuts against the bottom of the bore section 45.

The mass of the spindle element 15 and the mass of the impact element 37 are substantially the same. In this manner, the drilling progress when operating in the impact drilling mode is most advantageous. When the impact power drill is in its impact drilling position, and the non-illustrated tool is pressed against the object to be drilled, the spindle element 15 and the impact element 37 are displaced toward the motor to such an extent that the balls 39 reach the region of the helical radial projections 41. Inasmuch as in the illustrated embodiment, the number of helical projections 41 is three, during each one-third of rotation of the impact element 37, the latter is displaced axially against the force of the spring 47 when the balls 39 cooperate with the helical cam surfaces of the helical projections 41. Afterwards, when the ball 39 reaches the respective depression or interruption 42, the impact element 37 is rapidly displaced by the spring 47 toward the spindle element 15 so that the extension 36 of the impact element 37 abuts against the bottom of the blind bore 35 of the spindle element 15, thus subjecting the latter to uniform axial impacts. As soon as the tool is removed from the object on which the impact drilling operation has been previously performed, the spring 48 displaces the impact element 37 and also the spindle element 15 leftwardly as illustrated in FIG. 1, so that the balls 39 are removed from the path of rotation of the helical projections 41. From then on, the power drill can be operated in a normal drilling mode.

Figure 4:
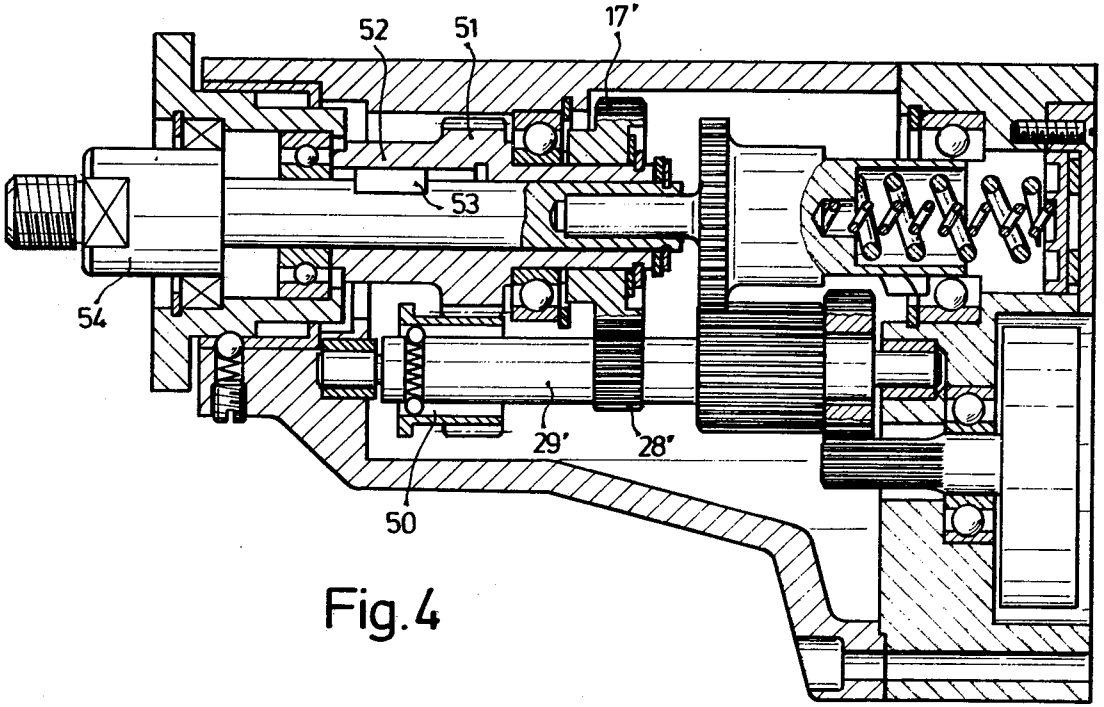
FIG. 4 is a modification of the power drill of FIG. 1 a similar view.

FIG. 4 illustrates a modification of the basic concept of the present invention as illustrated in and described in connection with FIG. 1, such a modification differing from the previously described one mainly in that this power drill can operate at two different transmission ratios, i.e. at different rotational speeds of the spindle element, as opposed to the power drill of FIG. 1 which can only operate at a single speed. In order to obtain such different transmission ratios, an additional gear wheel pair 50, 51 is provided, of which the gear wheel 50 is mounted on the countershaft 29' and the gear wheel 51 is mounted on an intermediate shaft element 52 which is connected to the spindle element 54 for shared rotation therewith by means of a wedge 53. Depending on the fact whether the gear pair 17', 28' or the gear pair 50, 51, transmit the torque, the spindle element 15 rotates at a higher or at a lower speed. The remaining parts of the embodiment of FIG. 4 are the same as those previously discussed in connection with FIG. 1.

Figure 5:
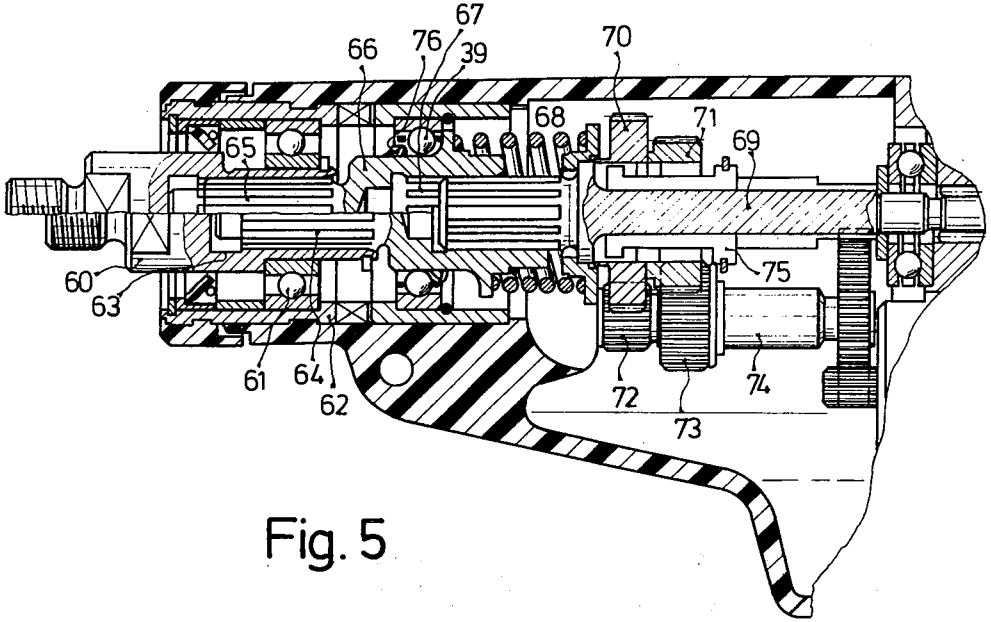
FIG. 5 is a view similar to FIG. 1 but of a further modification.

The embodiment of FIG. 5 differs in many aspects from that previously discussed, but the principle of this embodiment is the same as that of the previously-discussed embodiments. Thus, only those components of the power drill of FIG. 5 which are needed for understanding the difference between this embodiment and the other embodiments will be discussed. The spindle element which has been assigned the reference numeral 60 is mounted in the housing 62 by means of a single anti-friction bearing 61. The spindle element 60 has a blind bore 63 provided with axially extending recesses 64, and an impact element 66 has a splined portion 65 which is received in the recesses 64 of the blind bore 63. This splined connection, as a result of the substantial axial length thereof, constitutes the second bearing for the spindle element 60 which is of a rather small axial length. The impact element 66, similarly to what has been previously discussed, is supported in the housing 62 by means of the spheres or balls 39. In addition thereto, the impact element 66 is formed with an axial blind hole equipped with inner sides 67 in which outer splines 68 of a driving shaft 69 engages. Gear wheels 70 and 71 are mounted on the driving motor output shaft 69, which gears 70 and 71 mesh with gears 72 and 73 which are mounted on a countershaft 74. The torque transmission by the respective gear wheel pair is selected by means of a wedge member 75.

Helical projections 76 are again provided at the outer circumferential surface of the impact element 66, which projections are configurated similarly to those discussed previously in connection with the other embodiments, and have the same function.

It will be understood that each of the elements described above, or two or more together, may also find a useful application in other types of constructions differing from the types described above.

While the invention has been illustrated and described as embodied in an impact drilling power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power drill tool comprising in combination, a housing; a spindle element mounted in said housing for rotation about an axis and for displacement in an axial direction; drive means for rotating said spindle element; and means for subjecting said spindle element to axially oriented impacts, including an impact element mounted in said housing at least for reciprocation in direction of said axis, means for reciprocating said impact element driven by said driven means, a blind axially oriented bore in said spindle element and having a first impact surface, and an axially oriented extension on said impact element and received in said blind bore of said spindle element and having a second impact surface which impacts said first impact surface upon axial displacement of said impact element in direction towards said spindle element.

2. A combination as defined in claim 1, wherein said first impact surface is a bottom surface of said bore; and wherein said second impact surface is a free end face of said axial extension.

3. A combination as defined in claim 1, wherein said drive means also rotates said impact element; and wherein said reciprocating means includes at least one cam surface at an outer circumferential surface of said impact element, which cam surface extends helically over a part of said circumferential surface and has an axial depression, biasing means urging said impact element toward said spindle element, and at least one cam follower element retained in said housing against axial displacement and adapted to engage said cam surface of said impact element to thereby displace said impact element away from said spindle element against the action of said biasing means when engaging the helical portion of said cam surface and to release said impact element for rapid displacement toward said spindle element under the action of said biasing means when encountering said axial depression.

4. A combination as defined in claim 3, wherein said cam follower element includes an outer race member stationarily mounted in said housing and having an inner circumferential groove, and a rolling body partially received in said circumferential groove and in contact with said outer circumferential surface of said impact element.

5. A combination as defined in claim 4; and further comprising means for mounting said impact element in said housing; and wherein said cam follower element constitutes a part of said mounting means.

6. A combination as defined in claim 3, wherein said impact element has at least one helical projection extending radially outwardly of said outer circumferential surface and having said cam surface, said depression being an interruption of said helical projection.

7. A combination as defined in claim 1, wherein said impact element and said spindle element have substantially the same mass.

8. A combination as defined in claim 1, wherein said housing has an axial dimension and an axially forward part; wherein said spindle element extends only over approximately one-half of said axial dimension of said housing; and further comprising means for mounting said spindle in said axially forward part of said housing.

9. A combination as defined in claim 8, wherein said mounting means includes two anti-friction bearings interposed between said forward part of said housing and said spindle element.

10. A combination as defined in claim 1, wherein said drive means includes a driving motor, and a transmission between said driving motor and said spindle element for rotating the same, and between said driving motor and said impact element for reciprocating the latter.

11. A combination as defined in claim 10, wherein said driving motor has an output shaft; and wherein said transmission includes a gear portion on said impact element, and a countershaft mounted in said housing and driven into rotation from said output shaft and having a gear meshing with said gear portion of said impact element.

12. A combination as defined in claim 11; wherein said transmission further includes a gear wheel rigidly connected with said spindle element, and an additional gear mounted on said countershaft for shared rotation therewith and in meshing engagement with said gear wheel.

13. A combination as defined in claim 12, wherein the number of gear teeth of said additional gear wheel is considerably lower than that of said gear wheel.

14. A combination as defined in claim 1; and further comprising means for connecting said impact element with said spindle element for synchronous rotation about said axis but with freedom of axial displacement relative thereto.

15. A combination as defined in claim 14, wherein said connecting means includes axially extending projections on one of said elements and complementary axial recesses on the other element.

16. A combination as defined in claim 15, wherein said axial projections are provided on said extension and said axial recesses are formed in said blind bore.

17. A combination as defined in claim 1, wherein said impact element has an axially extending blind hole within a portion thereof facing away from said spindle element, said blind hole having a plurality of axially extending recesses; wherein said drive means includes an output shaft which has a plurality of spline received in said axial recesses of said blind hole; and further comprising a countershaft and a plurality of gears mounted on said output shaft and on said countershaft, respectively, for shared rotation therewith, and in meshing engagement with one another.

18. A power tool comprising, in combination, a housing; a spindle element mounted in said housing for rotation about an axis and for displacement in axial direction; drive means for rotating said spindle element; and means for subjecting said spindle element to axially oriented impacts, including an impact element mounted in said housing at least for reciprocation in direction of said axis, means for reciprocating said impact element driven by said drive means, a blind axially oriented bore in one of said elements and having a first impact surface, and an axially oriented extension on the other element and received in said blind bore of said one element and having a second impact surface which impacts said first impact surface upon axial displacement of said impact element in direction toward said spindle element, wherein said drive means also rotates said impact element; and wherein said reciprocating means includes at least one cam surface at an outer circumferential surface of said impact element, which cam surface extends helically over a part of said circumferential surface and has an axial depression, biasing means urging said impact element toward said spindle element, and at least one cam follower element retained in said housing against axial displacement and adapted to engage said cam surface of said impact element to thereby displace said impact element away from said spindle element against the action of said biasing means when engaging the helical portion of said cam surface and to release said impact element for rapid displacement toward said spindle element under the action of said biasing means when encountering said axial depression, wherein said impact element has at least one helical projection extending radially outwardly of said outer circumferential surface and having said cam surface, said depression being an interruption of said helical projection, and wherein said spindle element and said impact element are mounted in said housing for axial displacement between a normal drilling position in which said cam follower element is located out of the path of rotation of said helical projection, and an impact drilling position in which said cam follower element cooperates with said cam surface of said helical projection.

19. A combination as defined in claim 18, wherein said biasing means includes two springs one of which permanently urges said impact element and spindle element toward said normal drilling position thereof, and the other of which stores energy during the engagement of said cam follower element with said helical portion of said cam surface to release the stored energy upon juxtaposition of said cam follower element with said interruption in said impact drilling position.

20. A combination as defined in claim 19, wherein said housing has an abutment surface and said impact element has a blind bore; and wherein said springs extend and abut with their ends against said abutment surface and said blind bore of said impact element.

* * * * *